United States Patent [19]

Morrison, Jr.

[11] Patent Number: 4,589,283

[45] Date of Patent: May 20, 1986

[54] ASCENT GAUGE FOR DIVERS

[76] Inventor: Francis V. Morrison, Jr., 28 Water St., Charlestown, Mass. 02129

[21] Appl. No.: 632,126

[22] Filed: Jul. 18, 1984

[51] Int. Cl.[4] ..... G01F 23/14

[52] U.S. Cl. ..... 73/432 R; 73/300; 73/170 A

[58] Field of Search ..... 73/300, 861.76, 432 D, 73/170 A; 368/327

[56] References Cited

U.S. PATENT DOCUMENTS

| | | | |
|---|---|---|---|
| 2,660,144 | 11/1953 | Newcum | 73/861.76 X |
| 2,724,969 | 11/1955 | Blosev | 73/861.76 |
| 2,889,707 | 6/1959 | Snider | 73/861.75 |
| 2,986,038 | 5/1961 | Cerney | 73/300 X |
| 4,327,584 | 5/1982 | Alinari | 73/432 R X |
| 4,346,589 | 8/1982 | Kienzle et al. | 73/861.76 |

FOREIGN PATENT DOCUMENTS

| | | | |
|---|---|---|---|
| 0352828 | 6/1905 | France | 73/300 |

*Primary Examiner*—Daniel M. Yasich

*Attorney, Agent, or Firm*—John P. McGonagle

[57] ABSTRACT

A gauge for warning a scuba diver of an unsafe rate of ascent in the ocean or sea. The gauge is normally attached to the diver's forearm or wrist by means of straps. As the diver ascends, water flows through the gauge. A disk which is pivotally attached within the gauge in the path of the water flow moves in response to the water flow. As the disk moves, an indicator attached to the disk moves along a calibrated scale.

11 Claims, 6 Drawing Figures

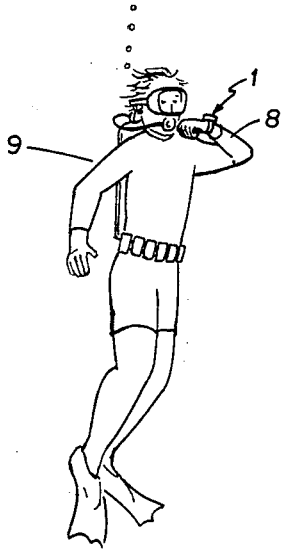
FIG 1
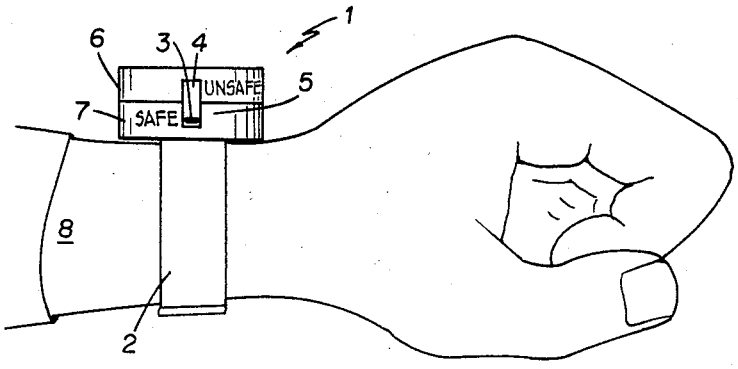
FIG 2
FIG 3
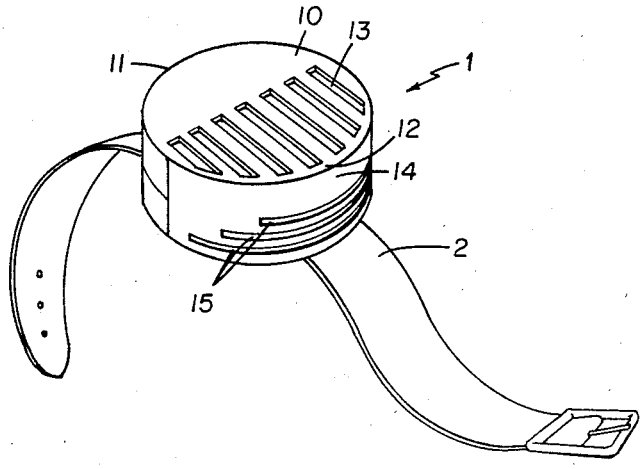
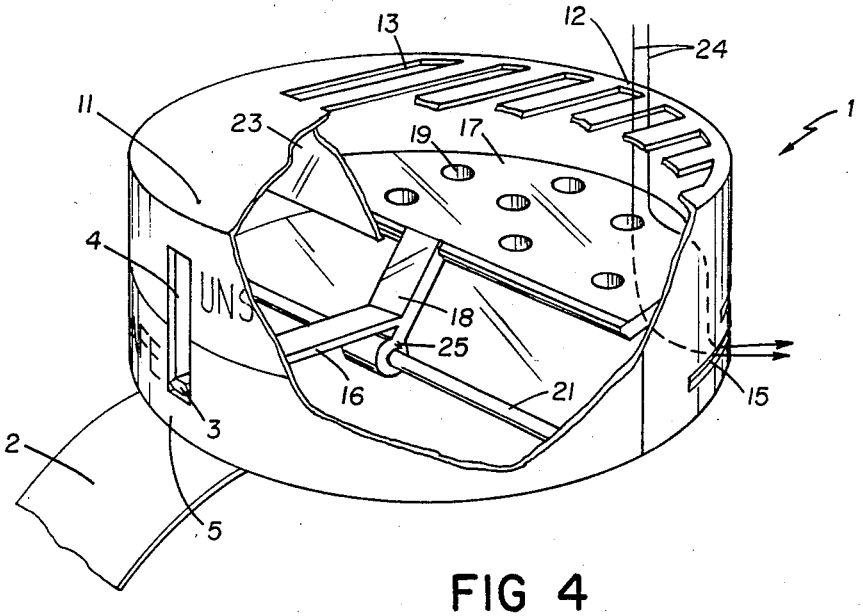
FIG 4

ASCENT GAUGE FOR DIVERS

BACKGROUND OF THE INVENTION

This invention relates to gauges and particularly to a gauge for measuring the rate of ascent for scuba divers.

The rate of ascent is critical to the prevention of serious, even potentially fatal, lung and brain damage. Boyle's Law states that if the temperature is kept constant the volume of a gas will vary inversely with the absolute pressure while the density varies directly. This means that if the pressure on a gas is doubled, the density too is doubled but the volume is decreased to one-half the original volume. In seawater each 33 feet (34 feet for fresh water) in depth is equal to one additional atmosphere of pressure (14.7 psi). For this reason, when divers have completely filled their lungs with air at a depth of 33 feet, their lungs are holding twice as much air as when filled at surface level. For each 33 feet additional in depth, the volume of air needed to fill the lungs is increased accordingly. At 66 feet, the water exerts additional pressure of 29.4 psi (two atmospheres of pressure), so that the total pressure is 44.1 psi or three atmospheres of pressure, and a diver's lungs will hold three times as much air as when filled at surface. The density is, therefore, actually three times greater than it was at the surface, but the volume is one-third less.

The most serious damage the lungs can suffer in diving is from the expansion of air as a result of pressure reduction. If air is taken into the lungs and held in at a depth of 125 feet, it will increase five times in volume if a diver moves quickly to the surface where the external pressure is proportionately reduced to one-fifth. It is easy to understand how lung damage could be serious, even fatal, is a diver held his breath while surfacing.

If a diver fills his lungs with air while at depth to the size they are normally on the surface, and then ascends, the lungs will progressively expand. If the lungs are not emptied of air fast enough during the ascent, rupture of membranes and capillaries may result, permitting air to enter the bloodstream. This would be an air embolism. Air embolisms are caused by air being forced through the lung walls into the bloodstream, when holding one's breath, while ascending with a breathing apparatus. They can occur when one ascends from a depth as shallow as 7 feet. At the outside pressure decreases, the inside pressure of your lungs simultaneously increases, and when you reach the surface of the water, such overexpansion (like that of a toy balloon) reaches the breaking point with a possible rupture of the lung and subsequent leakage of air bubbles from the lungs into the bloodstream. Air bubbles are apt to lodge in the brain and cause permanent damage or death.

Other dangers of ascending too rapidly include spontaneous pneumothorax and subcutaneous and mediastinal emphysema. Spontaneous pneumothorox is caused by air getting into the space between the lungs and the lining of the chest wall causing the lung to collapse, particularly at least, as pressure increases. Enough such pressure will seriously impair breathing and heart action. Subcutaneous and mediastinal emphysema is caused by the expansion of air upon ascent in the tissue spaces of the mediastinum (air space in the middle of the chest). Whatever the degree of emphysema, air embolism and its associated dangers may be present.

It has been found that in making a free ascent a diver's rate of ascent should not exceed 60 feet per minute. During ascention the air volume in the diver's lungs will increase with the lessening of water pressure. The diver must exhale continually as he rises. If the diver senses a slight pressure pain in the chest, he is beginning to feel the effects of overexpansion, meaning that he is either rising too fast or not exhaling adequately. However, an air embolism can occur without warning of pain. The crucial point of ascent occurs in the last ten feet, where pressure change is the greatest. From this depth upward, the diver must exhale as vigorously as possible.

As stated above, the rate of ascent is critical to the prevention of serious, even potentially fatal, lung and brain injury. Studies have been done which show that a large percentage of all divers ascend too rapidly thereby risking air embolism. The proper rate of ascent is 60 feet per minute or less.

At this time the most common method taught for controlling the rate of ascent is for the ascending diver to watch his air exhaust bubbles and to rise no faster than the bubbles. This method is not reliable for several reasons. Bubbles speed up as they reach the surface which may cause too rapid an ascent during the depths of greatest pressure change. Bubbles are not that easily visible and are especially difficult to track in murky water when also watching out for other divers and boats.

A diver could also use, in combination, a dive watch and a depth gauge. From this the diver could calculate his rate of ascent. However, this is not always practical and is difficult to accomplish with accuracy. Depth gauges are not graded fine enough to show ascent levels accurately. Because of the need to watch two separate devices at the same time, safe ascent procedures cannot be followed. The basic safe procedure is for the diver to hold a hand over his head while slowly circling looking for boats or other obstacles.

The two above methods are difficult for the diver. There are no reference points. The physics of the expanding air on buoyancy increases the ascent speed. And finally, the ascending diver must keep a close watch for boats when surfacing.

The prior art includes various devices which attempt to aid the diver in depth measurements and rates of changes in depth. A number of depth gauges for divers have been patented. Included among these are: U.S. Pat. No. 2,935,873, "Diver Held Depth Gauge"; U.S. Pat. No. 2,986,038, "Wrist Pressure Gauge"; U.S. Pat. No. 3,831,449, "Depth Gauge"; U.S. Pat. No. 3,990,306, "Temperature Compensated Depth Gauge For Scuba Diving"; and U.S. Pat. No. 4,107,996, "Pressure Gauge". These are all sealed gauges for measuring depth. None have the ability in themselves to measure rate of change in depth against critical ascent speed.

The prior art also includes a device called Dive Bubbles. The device is an ascent control device and follows the bubble theory described above. In theory, a small ball is released from a special holder and rises through the water at the ascent rate required by dive tables. Since the Dive Bubble is based on the bubble theory, it does not solve the problems associated with the air exhaust bubbles. The diver must watch the ball as it rises. This precludes the diver from turning around and watching for boats and other obstacles. The ball increases speed as it gets closer to the surface. If the diver stops or slows down, he is required to release another ball. There is no gradiation ability. After each dive, the diver must chase and recover the floating balls or replace them at additional cost.

Another device on the market designed to assist divers during ascents is the Deco-Brain. This is a solid-state electronic dive computer which consolidates the functions of the watch, depth gauge, diving table and decompression meter. A red warning light blinks if the diver's ascent rate exceeds 33 feet per minute. If the red light blinks in one second intervals or less, the ascent is between 33 feet and 39 feet per minute. If the red light is continuously illuminated, the ascent rate is approximately 66 feet per minute. There are no other gradations. The unit requires batteries and there are conditions under which the diver cannot determine if the device is working. The device is bulky and expensive.

The present invention comprises a relatively inexpensive mechanical gauge for for warning a scuba diver of an unsafe rate of ascent. The gauge is worn on the diver's wrist to monitor ascent speed. As the driver rises, water is passed through the gauge against a float causing an indicator to move. If the diver ascends too quickly, the indicator will move into an unsafe zone thereby signaling to the diver that he is rising too fast.

Accordingly, an object of this invention is to provide a new and improved gauge for warning scuba divers of an unsafe rate of ascent in the ocean or sea.

Another object of this invention is to provide an ascent gauge which is inexpensive and easy to use while allowing the diver to follow safe ascent procedures even under adverse conditions.

A more specific object of this invention is to provide a new and improved ascent gauge for scuba divers which includes a float indicator calibrated and designed to react against the flow of water into the gauge thereby indicating to the ascending diver his safe and/or unsafe rate of ascent.

BRIEF DESCRIPTION OF THE DRAWINGS

FIG. 1 is a view of a scuba diver wearing the ascent gauge.

FIG. 2 is a frontview of the ascent gauge as worn by a scuba diver.

FIG. 3 is a perspective view of the ascent gauge.

FIG. 4 is a plan view of the ascent gauge.

DETAILED DESCRIPTION OF THE INVENTION

Figure 5:
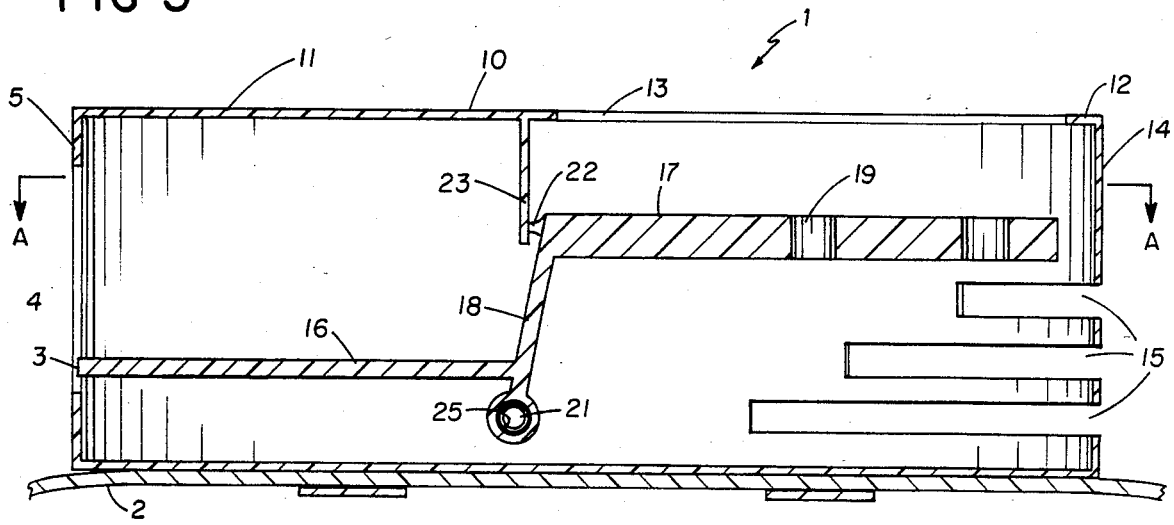
FIG. 5 is a cross-sectional side view of the ascent gauge along the line B—B of FIG. 6.

Referring more particularly to the drawings reference numeral 1 refers generally to the ascent gauge comprising one embodiment of the present invention. FIG. 1 is a view of a scuba diver 9 wearing the ascent gauge 1 on the lower portion of his left forearm 8. FIG. 2 is a view from the front 5 of the ascent gauge 1. The ascent gauge 1 is attached to a wrist strap 2. This view shows an indicator point 3 within an opening 4 into the ascent gauge 1. The ascent guage 1 front 5 is divided into two zones: an upper half 6 and a lower half 7. When the indicator point 3 moves to the upper half 6 it is in the "unsafe" zone and when the indicator point 3 moves to the lower half 7 it is in the "safe" zone. The ascent gauge 1 is attached by means of the wrist strap 2 to the diver's lower forearm 8. FIG. 1 shows how a scuba diver 9 would hold his forearm 8 with the ascent gauge 1 attached to it while rising through water.

FIG. 3 is a perspective view of the ascent gauge 1. The ascent gauge top 10 is divided generally into two halves: a forward half 11 and a rearward half 12. The rearward half 12 has openings 13 into the ascent gauge 1, the forward half 12 does not. The ascent gauge back 14 also has openings into the ascent gauge 1.

Figure 6:
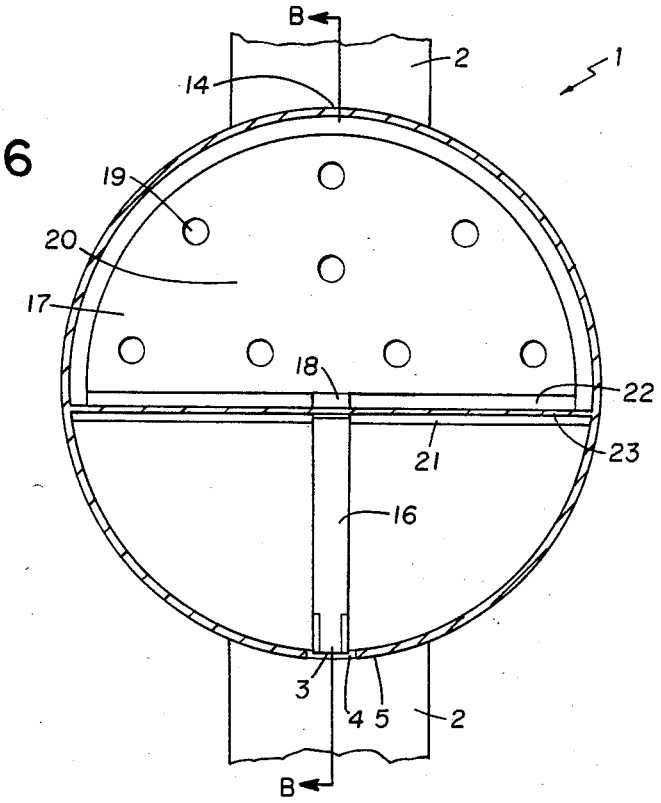
FIG. 6 is a cross-sectional top view of the ascent gauge along the line A—A of FIG. 5.

FIG. 4 is a plan view of the ascent gauge 1. The indicator point 3 at the opening 4 in the ascent gauge front 5 is attached to a longitudinal element 16 which is joined to a half-moon shaped disk 17 at a point 18, all within the ascent gauge 1. The disk 17 has perforations 19 and, as can be seen in FIG. 6, is positioned in the back half 20 of the ascent gauge 1 below the rearward half 12 of the ascent gauge top 10. The disk 17 and longitudinal element 16 are pivotally connected at 18 to an element 21 horizontally positioned approximately in the middle across the inside of the ascent gauge 1.

FIG. 6 is a top view of the ascent gauge 1 along the plane A—A of FIG. 5. Visible in this view are the indicator point 3 attached to the longitudinal element 16 connected to the disk 17 both of which are pivotally connected at 18 to the horizontal element 21. FIG. 5 is a side view of the ascent gauge 1 along the vertical plane B—B of FIG. 6. The indicator point 3 is attached to the disk 17 at 18 and pivotally connected to the horizontal element 21. At the front side of the disk 17 is a small protrusion 22 which comes to rest against a vertical element 23 attached to the inside top 10 of the ascent gauge 1 just above the junction point 18. As can be seen from FIG. 6 the vertical element 23 runs across the inside middle of the ascent gauge 1. The openings 15 in the back 14 of the ascent gauge 1 are also visible.

OPERATION

As can be seen from FIG. 1 and FIG. 2, the ascent gauge 1 is attached by means of a strap 2 to the scuba diver's lower forearm 8. As the diver 9 rises he holds the forearm 8 substantially horizontal across his body. The ascent gauge 1 is attached to the diver's lower forearm 8 so that the front 5 of the ascent gauge 1 is visible to the diver 9.

As the diver 9 rises water will come in through the openings 13 in the top of the rearward half 12 of the ascent gauge 1. This can be seen in FIG. 3, FIG. 4, and FIG. 5. The water flows through the ascent gauge 1 along the path 24 of FIG. 4 and exits through the back openings 15. The movement of the water 24 through the ascent gauge 1 pushes downward against the disk 17 curved side causing the longitudinal element 16 to pivot upward. The indicator point 3 attached to the longitudinal element 16 is visible to the diver 9 through the opening 4.

The faster the diver 9 rises, the greater the downward water pressure exerted against the disk 17. The more downward pressure that is exerted against the disk 17, the farther upward the longitudinal element 16 will pivot. This will bring the indicator point 3 into the "unsafe" zone 6 on the front 5 of the ascent gauge 1 if the diver's ascent is too fast. Thus, the diver 9 has a direct measurement of his rate of ascent as it relates to his safety.

The disk 17 has a lower specific gravity than water and will, therefore, try to float upward in a steady state condition. This will cause the disk 17 curved side to rise and the disk 17 and longitudinal element 16 to pivot about the horizontal element 21, with the longitudinal element 16 moving downward and the indicator point 3 moving into the safe zone 7 on the front 5 of the ascent gauge 1. The stop 22 also shown in FIG. 5 and the vertical element 23 shown in FIG. 5 place a limit on the extent to which the disk 17 will rise. The vertical element 23 will also channel the water coming through the top openings 13 across and through the disk 17 out the back openings 15. The perforations 19 in the disk 17 provide another path 24 for the water through the disk 17 while at the same time allowing the disk 17 to react to the water flow. The perforations 19 prevent the disk 17 from being too sensitive to water pressure and also allows the disk 17 a quicker recovery to a steady state condition. The combination of specific gravity of the disk 17, disk perforations 19, sizes of top openings 13, and sizes of back openings 15 determines the disk 17 curved side downward movement as the diver ascends in the ocean or sea. All are designed and calibrated so that when the indicator point 3 moves into the unsafe zone 6 on the front 5 of the ascent gauge 1, the diver's ascent is exceeding 60 feet per minute. For a greater margin of safety, the initial movement of the indicator point 3 into the unsafe zone 6 may be set at a lesser figure, e.g., 35 feet per minute. The ascent gauge 1 is not designed to variable measure and report the speed of ascent, but it is designed to warn the diver of an unsafe condition when his ascent speed is equal to or greater than a certain number of feet per minute. When the diver slows down his ascent to a speed below that number, the indicator 3 will move back into the safe zone 7.

In another embodiment of this invention, a spring 25 is attached to the pivot element 21 and connected to the disk 17 whereby the disk 17 would return to a rest state immediately after downward water pressure ceased. Over-sensitivity to downward water pressure would also be reduced. A light with a push-button battery could also be attached to the indicator point 3 for greater visibility under low-light conditions.

In the present embodiment, the indicator point 3 would be painted with luminescent color. The upper zone 6 of the ascent gauge front 5 would also be colored to indicate an "unsafe" rate of ascent. The disk 17 would be made of a non-corrosive plastic as would the ascent gauge exterior. The longitudinal element 16 could be made of stainless steel.

It is understood that the above-described embodiment is merely illustrative of the application. Other embodiments may be readily devised by those skilled in the art which will embody the principles of the invention and fall within the spirit and scope thereof.

I claim:

1. A gauge for warning a scuba diver of an unsafe rate of ascent in the ocean or sea comprising:

a casing with top, bottom, front and back sides, the top side of which has openings positioned toward the back side, the front side of which has a vertical opening approximately in the middle, and the back side of which has openings positioned toward the bottom;

a horizontal element fastened to and positioned within the casing perpendicular to the front and back sides approximately in the middle across the inside of the casing in a plane parallel to the top and bottom sides;

a disk pivotally attached within the casing to the horizontal element; and a longitudinal element with two ends, one end of which is joined to the disk, and the other end of which is positioned at the casing front side opening.

2. A gauge for warning a scuba diver of an unsafe rate of ascent in the ocean or sea as recited in claim 1 wherein:

the disk has a plurality of perforations.

3. A gauge for warning a scuba diver of an unsafe rate of ascent in the ocean or sea as recited in claim 2 wherein:

the disk is positioned in a plane approximately parallel to the casing top and bottom sides.

4. A gauge for warning a scuba diver of an unsafe rate of ascent in the ocean or sea as recited in claim 3 wherein:

the disk is further positioned toward the casing back side above the back side openings.

5. A gauge for warning a scuba diver of an unsafe rate of ascent in the ocean or sea as recited in claim 4 wherein:

the disk has a half-moon shape with its curved side positioned toward the casing back side above the back side openings.

6. A gauge for warning a scuba diver of an unsafe rate of ascent in the ocean or sea as recited in claim 5 wherein:

the disk is pivotally attached to the horizontal element within the casing so that its curved side swings downward as water flows into the casing through the openings in the top side.

7. A gauge for warning a scuba diver of an unsafe rate of ascent in the ocean or sea as recited in claim 6 wherein:

the disk is made of a material which tends to float in water.

8. A gauge for warning a scuba diver of an unsafe rate of ascent in the ocean or sea comprising:

a casing with top, bottom, front and back sides, the top side of which has openings positioned toward the back side, the front side of which has a vertical opening approximately in the middle, and the back side of which has openings positioned toward the bottom;

a horizontal element fastened to and positioned within the casing perpendicular to the front and back sides approximately in the middle across the inside of the casing in a plane parallel to the top and bottom sides;

a disk, made of a material tending to float in water and having a plurality of perforations and a half-moon shape, positioned in a plane approximately parallel to the casing top and bottom sides, further positioned with its curved side toward the casing back side above the back side openings, pivotally attached to the horizontal element within the casing so that its curved side tends to swing downward as water flows into the casing through the openings in the top side;

a vertical, fin-shaped element within the casing attached to the interior of the top side running across the inside middle of the casing in a plane parallel to the front side and extending approximately one-third to one-half of the distance between the top and bottom sides; and a stop means on the straight side of the disk for limiting the upward pivotal movement of the disk positioned to encounter the vertical element as the disk curved side begins to swing upward through a plane approximately parallel to the casing top and bottom sides.

9. A gauge for warning a scuba diver of an unsafe rate of ascent in the ocean or sea as recited in claim 8 wherein:

the longitudinal element is joined to the disk so that the end positioned at the casing front side opening rises as the disk's curved side swings downward.

10. A gauge for warning a scuba diver of an unsafe rate of ascent in the ocean or sea as recited in claim 9 further comprising:

a means for calibratedly resisting the downward swing of the disk.

11. A gauge for warning a scuba diver of an unsafe rate of ascent in the ocean or sea as recited in claim 10 wherein:

the means for calibratedly resisting the downward swing of the disk is a spring.

* * * * *